US009814642B2

(12) United States Patent
Purdy et al.

(10) Patent No.: US 9,814,642 B2
(45) Date of Patent: Nov. 14, 2017

(54) MATTRESS SYSTEM INCLUDING LOW PRESSURE COMMUNICATION AIR CHAMBER

(75) Inventors: William Purdy, White Plains, NY (US); Robert Purdy, Bedford, NY (US)

(73) Assignee: MOLNLYCKE HEALTH CARE AB, Gothenburg (SE)

( * ) Notice: Subject to any disclaimer, the term of this patent is extended or adjusted under 35 U.S.C. 154(b) by 1118 days.

(21) Appl. No.: 13/493,641

(22) Filed: Jun. 11, 2012

(65) Prior Publication Data

US 2013/0145559 A1 Jun. 13, 2013

Related U.S. Application Data

(60) Provisional application No. 61/495,096, filed on Jun. 9, 2011.

(51) Int. Cl.

| | |
|---|---|
| ***A61G 7/057*** | (2006.01) |
| ***A47C 27/08*** | (2006.01) |
| ***A47C 27/15*** | (2006.01) |
| ***A47C 27/18*** | (2006.01) |

(52) U.S. Cl.

CPC ..... *A61G 7/05776* (2013.01); *A47C 27/081* (2013.01); *A47C 27/082* (2013.01); *A47C 27/15* (2013.01); *A47C 27/18* (2013.01); *A61G 7/05769* (2013.01)

(58) Field of Classification Search

CPC ..... A61G 7/057; A61G 7/05769; A61G 7/05776; A61G 2007/05784; A47C 27/082; A47C 27/081; A47C 27/18; A47C 27/15; A47C 27/16

USPC ..... 5/706, 710, 713, 714, 740

See application file for complete search history.

(56) References Cited

U.S. PATENT DOCUMENTS

| | | | | |
|---|---|---|---|---|
| 2,466,142 A | | 4/1949 | Yost | |
| 2,489,828 A | | 11/1949 | Springer | |
| 2,748,399 A | * | 6/1956 | Rockoff | 5/710 |
| 3,158,875 A | | 12/1964 | Fletcher | |
| 3,331,087 A | | 7/1967 | Barlow | |

(Continued)

FOREIGN PATENT DOCUMENTS

| | | |
|---|---|---|
| GB | 2300845 A1 | 11/1996 |
| IN | 5020/DELNP/2006 | 8/2007 |

(Continued)

OTHER PUBLICATIONS

Blue Chip Medical Products, Inc., Power Pro Elite® Mattress System—Model 9500, retrieved from the internet at https://web.archive.org/web/20100501171106/http://www.bluechipmedical.com/mattress-systems/air-mattress/power-pro-elite, at least as early as May 1, 2010, 4 pages.

(Continued)

*Primary Examiner* — David E Sosnowski
*Assistant Examiner* — David R Hare
(74) *Attorney, Agent, or Firm* — Kilpatrick Townsend & Stockton LLP

(57) ABSTRACT

The present invention relates to a mattress system in which a ultra low pressure plenum is positioned within the mattress system. In one embodiment, the ultra low pressure plenum is a bladder which is sandwiched between layers of a foam material. A plurality of ultra low pressure plenums formed as columns extending longitudinally or laterally along the length of the mattress system can be used.

4 Claims, 6 Drawing Sheets

(56) References Cited

U.S. PATENT DOCUMENTS 3,526,908 A * 9/1970 Davis ..... A61G 7/001 297/284.3
3,762,404 A * 10/1973 Sakita ..... A43B 17/035 128/DIG. 20
4,005,498 A * 2/1977 Starr ..... A61G 7/1009 5/81.1 R
4,024,861 A 5/1977 Vincent et al.
4,211,218 A 7/1980 Kendrick
4,272,856 A * 6/1981 Wegener ..... A61G 1/00 180/116
4,428,087 A * 1/1984 Horn ..... A47C 27/081 5/638
4,472,847 A * 9/1984 Gammons et al. ..... 5/713
4,517,690 A 5/1985 Wegener
4,566,445 A 1/1986 Jelsma et al.
4,665,908 A 5/1987 Calkin et al.
4,736,474 A 4/1988 Moran et al.
4,741,057 A * 5/1988 Rosier ..... A47C 27/081 441/129
4,977,629 A 12/1990 Jones
5,044,031 A 9/1991 Sherwood et al.
5,060,324 A 10/1991 Marinberg et al.
5,065,464 A 11/1991 Blanchard et al.
5,067,189 A 11/1991 Weedling et al.
5,092,007 A * 3/1992 Hasty ..... A61G 7/001 5/691
5,103,518 A 4/1992 Gilroy et al.
5,121,756 A * 6/1992 Koledin ..... A61F 5/05833 128/DIG. 20
5,243,722 A * 9/1993 Gusakov ..... A47C 7/021 297/DIG. 3
5,421,874 A 6/1995 Pearce
5,489,259 A 2/1996 Jacobs et al.
5,549,743 A 8/1996 Pearce
5,626,150 A 5/1997 Johnson et al.
5,626,657 A 5/1997 Pearce
5,708,999 A * 1/1998 Priolo ..... A47C 27/081 5/644
5,794,289 A 8/1998 Wortman et al.
5,806,796 A 9/1998 Healey
5,869,164 A 2/1999 Nickerson et al.
5,901,392 A * 5/1999 Hsieh ..... A47C 27/082 5/672
5,966,763 A 10/1999 Thomas et al.
6,020,055 A 2/2000 Pearce
6,073,291 A 6/2000 Davis
6,110,006 A 8/2000 Chen
6,119,292 A 9/2000 Haas
6,128,796 A 10/2000 McCormick et al.
6,145,143 A 11/2000 Hicks et al.
6,151,739 A 11/2000 Meyer et al.
6,154,900 A 12/2000 Shaw
6,175,980 B1 * 1/2001 Gaither ..... 5/654
6,197,099 B1 3/2001 Pearce
6,209,159 B1 * 4/2001 Murphy ..... 5/654
6,318,372 B1 11/2001 Hiebert et al.
6,343,385 B1 2/2002 Katz
6,351,863 B1 3/2002 Meyer et al.
6,381,787 B1 5/2002 Rogone et al.
6,397,419 B1 * 6/2002 Mechache ..... A47C 27/082 5/710
6,421,859 B1 7/2002 Hicks et al.
6,425,399 B1 7/2002 Hoster et al.
6,498,198 B2 12/2002 Pearce
6,588,511 B1 7/2003 Kriesel et al.
6,604,252 B1 8/2003 Lee et al.
6,701,544 B2 3/2004 Heimbrock
6,718,584 B2 4/2004 Rabaiotti et al.
6,823,549 B1 11/2004 Hampton et al.
6,857,151 B2 2/2005 Jusiak et al.
6,896,065 B2 5/2005 Kriesel et al.
6,986,170 B2 1/2006 Nelson
7,007,330 B2 3/2006 Kuiper et al.
7,032,261 B2 4/2006 Heimbrock
7,055,190 B2 6/2006 Barth et al.
7,065,815 B2 6/2006 Buchanan
7,146,660 B2 12/2006 Heimbrock
7,200,956 B1 4/2007 Kotha et al.
7,243,382 B2 7/2007 Weedling et al.
7,266,852 B2 9/2007 Davis
7,340,785 B2 3/2008 Weedling et al.
7,360,543 B1 4/2008 Coleman et al.
7,415,738 B2 8/2008 Weedling et al.
7,424,760 B2 * 9/2008 Chaffee ..... 5/644
7,464,422 B2 12/2008 Townsend
7,467,431 B2 12/2008 Weedling et al.
7,559,103 B2 7/2009 Barth et al.
7,565,710 B2 7/2009 Chambers et al.
7,591,029 B2 9/2009 Weedling et al.
7,650,654 B2 1/2010 Lambarth et al.
7,681,262 B2 3/2010 Weedling et al.
7,725,963 B2 6/2010 Johnson
7,739,758 B2 6/2010 Weedling et al.
7,832,039 B2 11/2010 Chambers et al.
7,900,299 B2 3/2011 Weedling et al.
7,904,971 B2 3/2011 Doria et al.
7,945,979 B1 5/2011 Lin
8,001,636 B2 8/2011 Nissen et al.
8,171,585 B2 5/2012 Mead et al.
8,191,188 B2 6/2012 Kaplan et al.
8,234,727 B2 8/2012 Schreiber et al.
8,261,388 B1 * 9/2012 Gill et al. ..... 5/710
8,302,222 B2 11/2012 Jasani
8,418,296 B1 4/2013 Hanlon et al.
8,566,977 B2 10/2013 Davis
8,661,580 B2 3/2014 Giap
8,667,631 B2 3/2014 Coates et al.
8,701,225 B1 4/2014 Latiff
8,756,725 B2 6/2014 Piegdon et al.
8,789,533 B2 7/2014 Steffens et al.
8,850,634 B2 10/2014 Ponsi et al.
8,858,478 B2 12/2014 Purdy et al.
8,898,833 B2 12/2014 Coates et al.
8,984,681 B2 3/2015 Ponsi
9,149,402 B2 10/2015 Gomez et al.
2002/0104535 A1 8/2002 Biondo et al.
2002/0144343 A1 10/2002 Kuiper et al.
2003/0192123 A1 * 10/2003 Chaffee ..... A47C 4/54 5/655.3
2003/0200611 A1 * 10/2003 Chaffee ..... A47C 20/027 5/710
2004/0083550 A1 * 5/2004 Graebe, Jr. ..... 5/654
2005/0028273 A1 2/2005 Weedling et al.
2006/0037136 A1 2/2006 Weedling et al.
2006/0179577 A1 8/2006 Chaffee
2007/0118993 A1 5/2007 Bates
2007/0283496 A1 * 12/2007 Skripps ..... 5/654
2008/0083067 A1 4/2008 Wheeldon-Glazener
2008/0134442 A1 6/2008 Hui
2008/0201855 A1 8/2008 Groves et al.
2009/0106893 A1 4/2009 Blevins
2009/0271928 A1 11/2009 Tishby et al.
2010/0096419 A1 4/2010 Stephens et al.
2010/0170037 A1 7/2010 Fletcher et al.
2011/0220695 A1 9/2011 Saunders et al.
2011/0241300 A1 10/2011 Schioler et al.
2011/0271444 A1 11/2011 Davis
2012/0011658 A1 1/2012 Weedling et al.
2012/0049605 A1 3/2012 Sanefuji et al.
2012/0079656 A1 4/2012 Lewis et al.
2012/0186587 A1 7/2012 Steffens et al.
2012/0284923 A1 * 11/2012 Jensen ..... A61G 1/04 5/627
2012/0311781 A1 12/2012 Purdy et al.
2012/0311787 A1 12/2012 Purdy et al.
2012/0311788 A1 12/2012 Jackson et al.
2013/0061396 A1 3/2013 Lafleche et al.
2013/0152950 A1 6/2013 Giap
2013/0180046 A1 7/2013 Davis et al.
2013/0198950 A1 8/2013 Purdy et al.
2013/0205495 A1 8/2013 Ponsi et al.
2013/0230685 A1 9/2013 Smith
2013/0276235 A1 10/2013 Kenalty et al.

(56) References Cited

U.S. PATENT DOCUMENTS

| | | | |
|---|---|---|---|
| 2013/0340770 | A1 | 12/2013 | Starr et al. |
| 2014/0007353 | A1 | 1/2014 | Stryker et al. |
| 2014/0041114 | A1 | 2/2014 | Davis |
| 2014/0075673 | A1 | 3/2014 | Weedling et al. |
| 2015/0052685 | A1 | 2/2015 | Bhat et al. |
| 2015/0101126 | A1 | 4/2015 | Reiners et al. |
| 2015/0128341 | A1 | 5/2015 | Kuiper |
| 2015/0135443 | A1 | 5/2015 | Cortez |
| 2015/0157521 | A1 | 6/2015 | Williams et al. |
| 2015/0238378 | A1 | 8/2015 | Bhat et al. |
| 2015/0290848 | A1 | 10/2015 | Sanefuji et al. |
| 2016/0067126 | A1 | 3/2016 | Purdy et al. |

FOREIGN PATENT DOCUMENTS

| | | |
|---|---|---|
| WO | 2001037774 | 5/2001 |
| WO | 2014043525 | 3/2014 |
| WO | 2015057775 | 4/2015 |
| WO | 2015128618 | 9/2015 |
| WO | 2015130703 | 9/2015 |
| WO | 2016037108 | 3/2016 |

OTHER PUBLICATIONS

EZ Way, Inc., EZ Matt, retrieved from the internet at https://web.archive.org/web/20090202082654/http://ezlifts.com/products/product_details.cfm?ProductID=27, at least as early as Feb. 2, 2009, 1 page.

Hill-Rom®, AirPal® Patient Air Lift, retrieved from the internet at https://web.archive.org/web/20101015045524/http://www.hill-rom.com/usa/AirPal.htm, at least as early as Oct. 15, 2010, 1 page.

Hill-Rom®, AIRPAL® Patient Transfer System, Dec. 22, 2008, http://www.discovermymobility.com/store/patient-lifts/hill-rom/hill-rom-patient-transfer-system.pdf, 2 pages.

HoverTech, HoverMatt® Air Transfer System, retrieved from the internet at https://web.archive.org/web/20110208085745/http://www.hovermatt.com/reusable, at least as early as Feb. 8, 2011, 1 page.

McAuley Medical, Inc., AirSlide for lateral transfer in-service video, uploaded to internet on Mar. 14, 2009, https://www.youtube.com/watch?v=u0tjtK_4gOE.

MDI—Medical Devices International, EMS IMMOBILE-VAC™, retrieved from the internet at https://web.archive.org/web/20081120122715/http://www.mdimicrotek.com/prod_ems-immobilevac.htm, at least as early as Nov. 20, 2008, 5 pages.

Smart Medical Technology, Inc.®, Liftaem™—Revolutionary Lateral Patient Transfer Device, uploaded to internet on Apr. 4, 2008, https://www.youtube.com/watch?v=K7_9XA-dS5k.

Stryker, Stryker Glide Lateral Air Transfer System, 2009, https://www.stryker.com/stellent/groups/public/documents/web_content/glidespecsheetrevd.pdf, 2 pages.

Sundance Enterprises, Inc., Healthcare Products, The DAP 210 Static Overlay Mattress, retrieved from the internet at https://web.archive.org/web/20061014205929/http://sundancesolutions.com/dap210.php, at least as early as Oct. 14, 2006, 2 pages.

Sundance Enterprises, Inc., Healthcare Products, The DAP Series, Static Air Support System and Fluidized Positioners, retrieved from the internet at https://web.archive.org/web/20061013091949/http://sundancesolutions.com/healthcareproducts.php, at least as early as Oct. 13, 2006, 1 page.

International Patent Application No. PCT/US2015/048642, International Search Report and Written Opinion, dated Dec. 2, 2015, 8 pages.

U.S. Appl. No. 13/493,582, Non-Final Office Action, dated Aug. 26, 2015, 10 pages.

U.S. Appl. No. 13/493,582, Non-Final Office Action, dated Feb. 29, 2016, 17 pages.

U.S. Appl. No. 13/834,911, Non-Final Office Action, dated Aug. 25, 2015, 8 pages.

* cited by examiner

MATTRESS SYSTEM INCLUDING LOW PRESSURE COMMUNICATION AIR CHAMBER

CROSS REFERENCE TO RELATED APPLICATION

This application claims the benefit of U.S. Provisional Patent Application No. 61/495,096, filed Jun. 9, 2011, the entirety of which is hereby incorporated by reference into this application.

BACKGROUND OF THE INVENTION

1. Field of the Invention

The present invention relates to a mattress system including low pressure air communicating chamber for providing support to a recumbent person.

2. Description of Related Art

Patients who lie on beds for a long term are easily subject to suffer from decubitus ulcers due to humidity or unrelieved pressure. A conventional mattress is made of thick and soft material, such as cotton. The thickness of the mattress can prevent the human body of the patient from directly touching a hard surface and provides some support. However, the conventional mattress is not sufficient to prevent decubitus ulcers.

U.S. Pat. No. 7,945,979 describes a mattress with airflow-circulating function. Filled static air chambers with enough air to support a patient are too stiff.

It is desirable to provide an improved mattress to provide contouring and sufficient support.

SUMMARY OF THE INVENTION

The present invention relates to a mattress system in which a ultra low pressure plenum is positioned within the mattress system. In one embodiment, the ultra low pressure plenum is a bladder which is sandwiched between layers of a foam material.

In an alternate embodiment, the mattress system is formed of a low pressure midsection which sits on a low pressure lower section. A top layer formed of foam is attached to the top of the low pressure midsection. The low pressure midsection can be formed of a plurality of ultra low pressure plenums formed as columns extending longitudinally or laterally along the length of the mattress system. The ultra low pressure plenum is a static air plenum with a fixed amount of air to provide ultra low pressure support. The ultra low pressure plenum can be formed of an air bladder within an elastic sleeve to provide a column of air. The ultra low pressure plenums are contained in a side-by-side relationship to provide communication between the ultra low pressure plenums. In one embodiment, the ultra low pressure plenums can be staggered. A fluid medium can be present in any spaces between the ultra low pressure plenums. The low pressure lower section can be an air plenum. In this embodiment, the low pressure midsection provides micro-contouring to the patient and low pressure lower section provides macro-contouring to a recumbent patient. The mattress system maximizes the number of degrees of freedom of patient movement.

The invention will be more fully described by reference to the following drawings.

DETAILED DESCRIPTION

Figure 1:
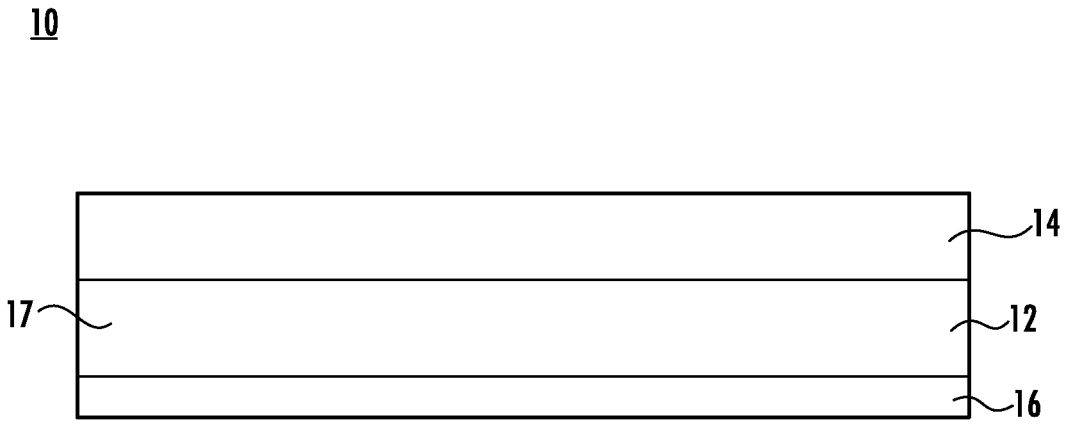
FIG. 1 is a schematic diagram end view of a mattress system in accordance with the teachings of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is a schematic diagram of mattress system 10 in accordance with the teachings of the present invention. In one embodiment, low pressure section 12 is positioned between top layer 14 and bottom layer 16. In this embodiment, top layer 14 and bottom layer 16 can be formed of a foam material. Low pressure section 12 can be formed of ultra low pressure plenum 17 having low pressure air therein. Ultra low pressure plenum 17 can be filled with a gas, such as air, nitrogen, hydrogen and helium. Pressure in ultra low pressure plenum 17 can be below about 20 mm of water or about 20 mm of water to about 5 mm of water or 10 mm or water to about 5 mm of water. Alternatively, pressure lower than 5 mm or water can be used in ultra low pressure plenum 17. It will be appreciated that all equivalents such as mm, Hg, and PSI can be used for measuring the pressure within ultra low pressure plenum 17. For example, low pressure section 12 can be formed of a closed plastic or urethane material. Low pressure section 12, top layer 14 and bottom layer 16 can be respectfully attached to one another for providing communication between top layer 14, low pressure section 12 and bottom layer 16.

Figure 2:
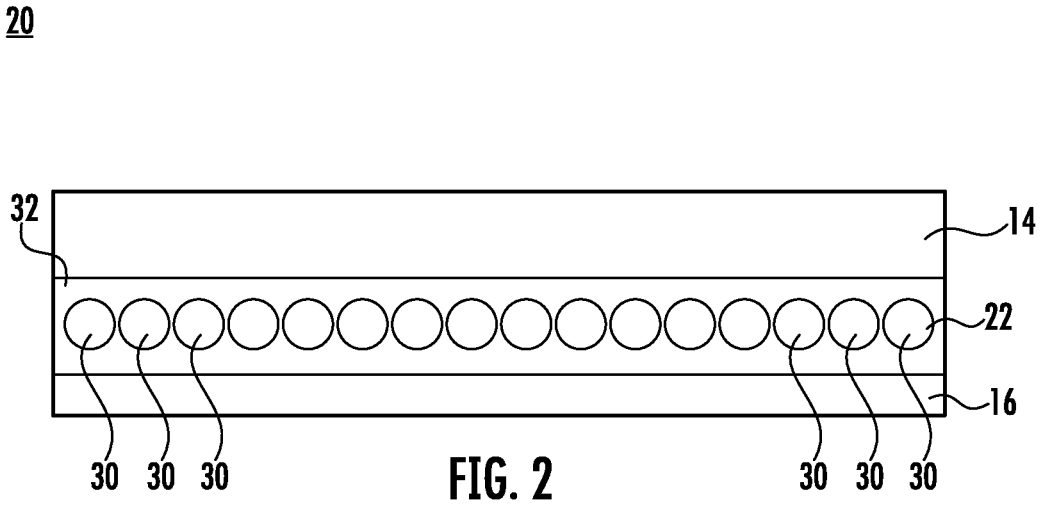
FIG. 2 is a schematic diagram end cross-sectional view of an alternate embodiment of a mattress system in accordance with the teachings of the present invention.
Figure 3:
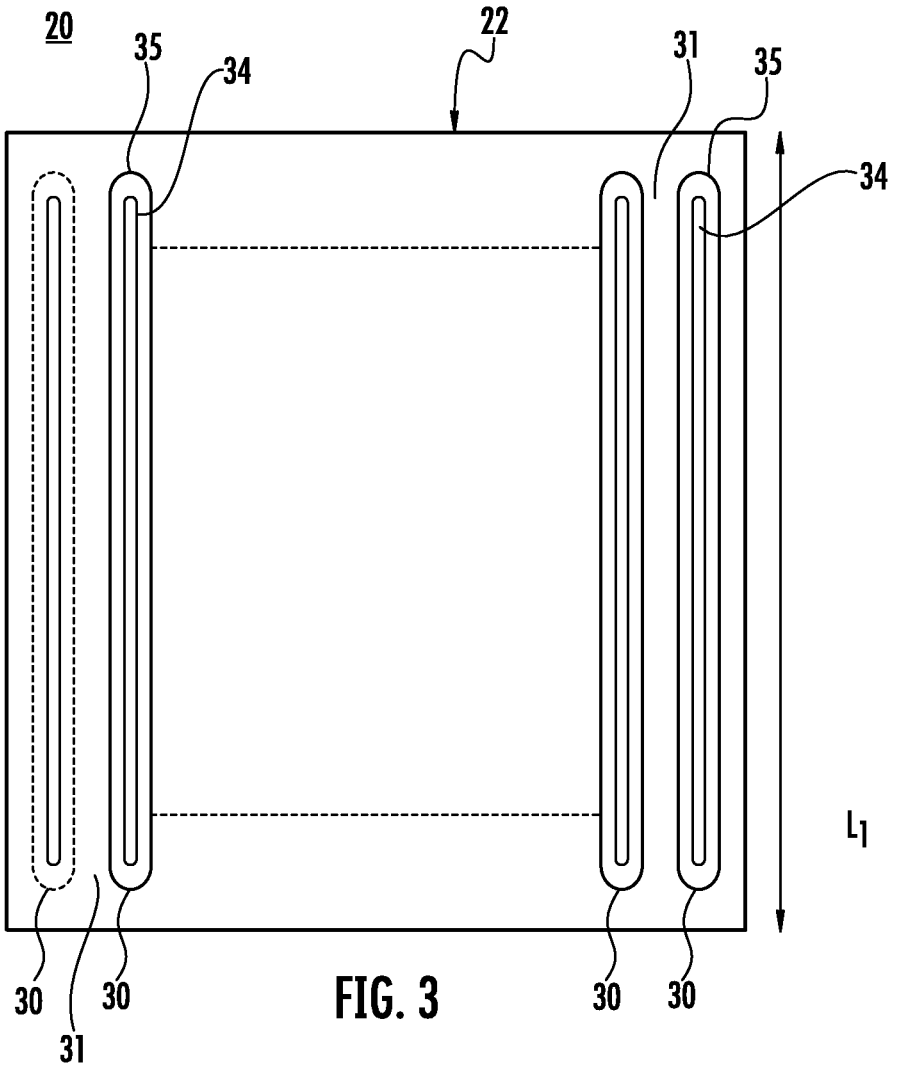
FIG. 3 is a schematic diagram top view of a low pressure midsection used in the mattress system shown in FIG. 2.

FIGS. 2 and 3 illustrate an alternative embodiment of mattress system 20. Low pressure midsection 22 can be formed of a plurality of ultra low pressure plenums 30 extending across the length $L_1$ of mattress system 20. Ultra low pressure plenums 30 can be contained in a side-by-side relationship within cover 32. Cover 32 can be formed of an elastic material. Ultra low pressure plenums 30 can be staggered and include fluid medium 31 in spaces between ultra low pressure plenums 30. Each of ultra low pressure plenums 30 can be formed of bladder 34 contained within elastic sleeve 35 to form a column. Bladder 34 can be formed of plastic or urethane. Bladder 34 can be filled with a gas. For example, the elastic sleeve can be formed of LYCRA® is a trademark of Invista and relates to a synthetic fiber of a polyester-polyurethane co-polymer.

Ultra low pressure plenums 30 can be filled with a gas, such as air, nitrogen, hydrogen and helium. The pressure within ultra low pressure plenum 30 can be below about 5 mm of water. Alternatively, pressure lower than 5 mm of water can be used in ultra low pressure plenum 17. It will be appreciated that all equivalents such as mm, Hg, and PSI can be used for measuring the pressure within ultra low pressure plenum 30. Alternatively, one or more of ultra low pressure plenums 30 can be filled with fluidized material 15 which can retain its shape after sculpting. The flowability or lubricity of fluidized material 15 can be increased by adding a lubricant or by the removal of air from the interstitial spaces or both. The preferred medium of fluidized material 15 is a particulate material that has been modified in such a way that it acts like a fluid Fluidized material 15 refers to a compound or composition which can be sculpted and retain its shape and has no memory or substantially no memory. The no memory or substantially no memory feature enables ultra low pressure plenum 30 to increase in height and maintain support of a body part. Fluidized material 15 is made of a viscosity that will allow it to contour but not collapse under the weight of the body part.

At sea level, the normal interstitial air pressure would exceed about 760 millibars of mercury. This increases or decreases marginally as altitude varies. Depending on the nature of the particulate fluidized material 15, the pressure can be lowered below about 500 millibars, preferably, about 350 millibars to about 5 millibars, while still maintaining the necessary flow characteristics of the product. The amount the pressure is lowered is dependent on the interstitial spaces needed to provide desired flow characteristics of the product.

Fluidized material 15 can include beads, such as polyethylene or polystyrene (PS) beads, expanded polyethylene (PE), crosslinked expanded polyethylene (PE), polypropylene (PP) pellets, closed cell foams, microspheres, encapsulated phase changing materials (PCM). The beads can be hard shelled or flexible. In one embodiment, the beads are flexible and air can be evacuated from the beads. In one embodiment, hard beads can be mixed with flexible beads in which air can be evacuated from the flexible beads. In an alternative embodiment, fluidized material 15 can a porous foam substance including pockets of interstitial air. In one embodiment, fluidized material 15 can be a polyurethane foam. The polyurethane foam can be open or closed cell and cut into small shapes such as spheres or blocks. For example, a sphere of polyurethane foam can have a size of 2 inches in diameter. For example, a block of polyurethane foam can be a 1×1×1 inch block.

Suitable examples of fluidized material 15 can be formed of a mixture of microspheres and lubricant. The microspheres can include hollow or gas-filled structural bubbles (typically of glass or plastic) with an average diameter of less than 200 microns. The composition flows and stresses in response to a deforming pressure exerted on it and the composition ceases to flow and stresses when the deforming pressure is terminated. For example, fluidized material 15 can be formed of a product referenced to as Floam™. A flowable compound comprising lubricated microspheres, including the compound itself, formulations for making the compound, methods for making the compound, products made from the compound and methods for making products from the compound as defined by U.S. Pat. Nos. 5,421,874, 5,549,743, 5,626,657, 6,020,055, 6,197,099, and 8,171,585, each of which is hereby incorporated by reference into this application. Ultra low pressure plenum 30 provides micro-contouring because fluidized material 15 can respond three-dimensionally. In an alternate embodiment, all of ultra low pressure plenums 30 can include fluidized material 15.

Figure 4:
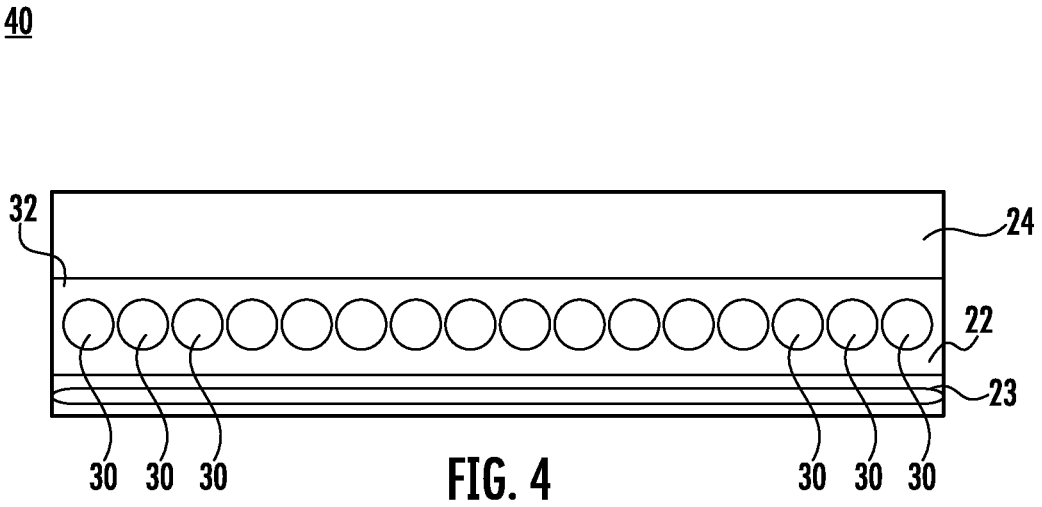
FIG. 4 is a schematic diagram end cross-sectional view of an alternate embodiment of a mattress system in accordance with the teachings of the present invention.

FIG. 4 illustrates an alternate embodiment of mattress system 40. In this embodiment, low pressure midsection 22 sits on low pressure lower section 23. For example, low pressure lower section 23 can be an air plenum. In one embodiment, low pressure lower section 23 can be formed of plastic or urethane. Top layer 24 is positioned over low pressure midsection 22. Top layer 24 can be formed of a foam material. For example, the pressure in low pressure lower section 23 can be below about 20 mm of water. It will be appreciated that all equivalents such as mm, Hg, and PSI can be used for measuring the pressure within ultra low pressure section 23. In this embodiment, low pressure midsection 22 provides micro-contouring to the patient and low pressure lower section 23 provides macro-contouring to a recumbent patient. Low pressure lower section 23, low pressure midsection 22 and top layer 24 can be respectfully attached to one another for providing communication between top layer 24 and low pressure midsection 22 and low pressure low pressure midsection 22 and low pressure lower section 23.

The amount of air used in ultra low pressure plenums 30 and/or the size of ultra low pressure plenums 30 can be varied to vary the amount of interluminal area that is supported to thereby effect the ability of low pressure midsection 22 to contour to the patient. In one embodiment, a greater amount of air can be used in ultra low pressure plenums 30 positioned, for example, under the sacrum and a lesser amount of air can be used in ultra low pressure plenums 30 positioned, for example, under the head or heels of a patient. In one embodiment, ultra low pressure plenums 30 with gas for fluid 31 can be rotated to alternate filling of ultra low pressure plenums 30 to provide alternating support.

Figure 5:
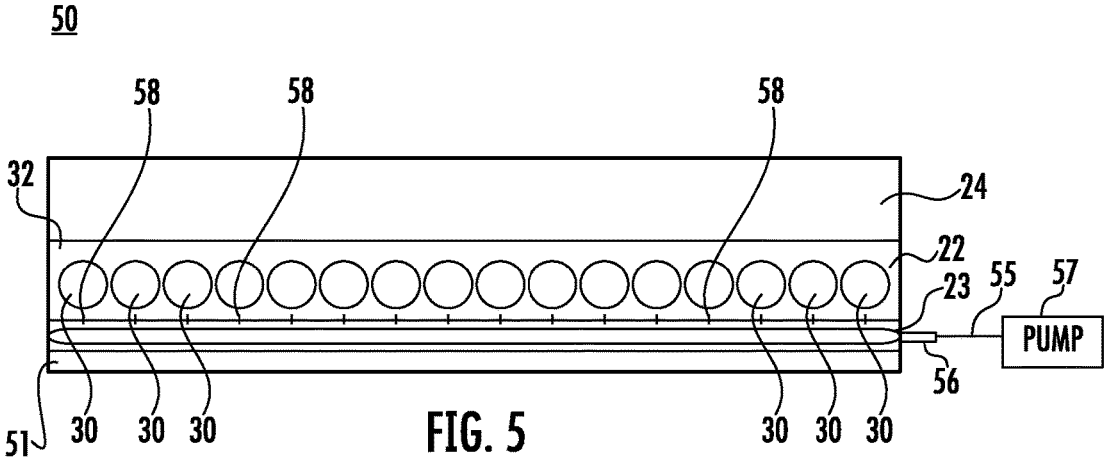
FIG. 5 is a schematic diagram end cross-sectional view of an alternate embodiment of a mattress system in accordance with the teachings of the present invention including a means to provide low air loss.

FIG. 5 illustrates an alternative embodiment of mattress system 50. Low pressure lower section 23 can include dynamic air. Air 55 is pumped into low pressure lower section 23 through valve 56 by pump 57. Low pressure lower section 23 is perforated with apertures 58. Air can flow from low pressure lower section 23 through low pressure midsection 22. Low pressure lower section 23 provides a dynamic amount of air to system 50 for adjusting the amount of air in system 50 and providing low air loss.

Low pressure lower section 23 can be received on foam bottom 51 for providing additional support.

Figure 6A:
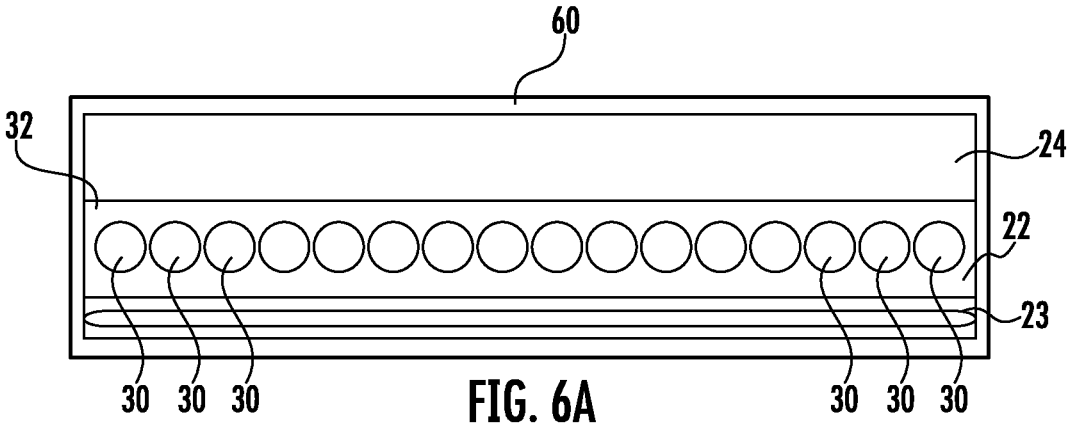
FIG. 6A is a schematic diagram end cross sectional view of the mattress system including a housing.
Figure 6B:
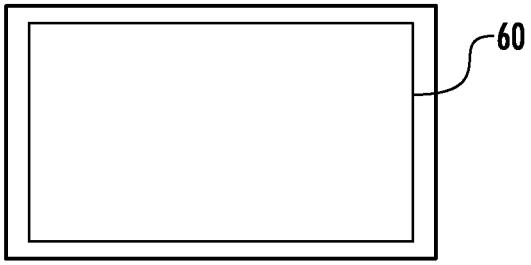
FIG. 6B is a top plan view of the mattress system shown in FIG. 6A.

Housing 60 can extend around mattress system 40 or mattress system 50, as shown in FIG. 6A-FIG. 6B. In one embodiment, top layer 24 can slide across ultra low pressure plenums 30 to reduce both friction and shear.

Mattress system 40 or mattress system 50 within housing 60 can provide six degrees of freedom by allowing plenums 30 to slide in any direction and provide shear relief and function relief. Housing 60 can be formed of an elastic material which is sewn around mattress system 40 or mattress system 50. Alternatively, housing 60 is formed of one or more sheets of a plastic or urethane material which are welded to one another.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A support system for a body part comprising:

a top layer, a bottom layer; and an ultra low pressure section positioned between said top layer and said bottom layer, said low pressure section including a gas therein, said ultra low pressure section comprises a plurality of ultra low pressure plenums formed as columns extending longitudinally or laterally along the length of the support system, said top layer, said ultra low pressure section, and said bottom layer are attached to one another for providing communication between the top layer, the ultra low pressure section and the bottom layer wherein said top layer displaces said gas within said low pressure section and wherein said bottom layer is a low pressure air plenum, said ultra low pressure section comprises a plurality of the ultra low pressure plenums formed as columns extending longitudinally or laterally along the length of the support system, each of said plenums if formed of a elastic sleeve around a closed plastic or urethane material to provide a column of gas and the plenums are contained in a side by side relationship, the pressure in said low air pressure air plenums being in the range of 20 mm of water and 5 mm of water, the pressure in each of said ultra low pressure plenums being less than about 5 mm of water wherein said ultra low pressure section provides micro-contouring to a user received on said top layer and said bottom layer provides macro-contouring, wherein said low pressure air plenum includes perforations and further comprising a valve connected to the low pressure air plenum and a pump, the pump providing a dynamic amount of air through said valve to the low pressure air plenum.

2. The support system of claim 1 further comprising a housing extending around said support system.

3. The support system of claim 1 wherein said top layer can slide over said ultra low pressure section.

4. The support system of claim 1 wherein said support system is a mattress.

* * * * *